United States Patent [19]
Kurovich et al.
[11] 4,365,494
[45] Dec. 28, 1982

[54] HYDRAULIC PRESS ELASTIC STAMPING TOOL

[76] Inventors: Arkady N. Kurovich, Tashkentsky pereulok, 5, korpus 3, kv. 67; Jury B. Krasnokutsky, Znamenskaya ulitsa, 38, korpus 1, kv. 201; Vyacheslav N. Sysoev, Khoroshevskoe shosse, 1, korpus 3, kv. 55; Lev D. Golman, Leninsky prospekt, 67, kv. 83, all of Moscow; Vladimir T. Zuev, ulitsa Marshala Birjuzova, 24, kv. 58, Odintsovo Moskovskoi oblasti; Viktor I. Nesterov, ulitsa Narodnogo opolchenia, 44, korpus 1, kv. 68, Moscow; Viktor A. Laboda, ulitsa generala Vitruka, 21, kv. 23, Kiev, all of U.S.S.R.

[21] Appl. No.: 192,215

[22] Filed: Sep. 30, 1980

[51] Int. Cl.[3] ..... B21D 22/12
[52] U.S. Cl. ..... 72/63
[58] Field of Search ..... 72/60, 63; 425/389, 425/394, 405, DIG. 14; 29/421 R

[56] References Cited

U.S. PATENT DOCUMENTS 4,080,139 3/1978 Hellgren ..... 72/63
4,105,388 8/1978 Hellgren ..... 72/63
4,112,724 9/1978 Claessen et al. ..... 72/63
4,163,378 8/1979 Hellgren ..... 72/63

FOREIGN PATENT DOCUMENTS 371965 of 0000 Sweden .
437628 of 0000 U.S.S.R. .
645731 of 0000 U.S.S.R. .

*Primary Examiner*—Leon Gilden
*Attorney, Agent, or Firm*—Fleit & Jacobson

[57] ABSTRACT

A hydraulic press elastic stamping tool having a tool body with a recess wherein is situated a flat elastic diaphragm whose flange makes contact with the tool body, forming a closed chamber. That chamber communicates with a source of working fluid under pressure through ducts in the tool body. The end portions of the diaphragm flange form, in conjunction with the main body of the diaphragm, an aperture closed at one end and dimensioned several times smaller than the thickness of the diaphragm. The aperture, in cross section thereof, is smoothly curved with respect to the plane of the diaphragm toward the bottom of the recess and the closed end of the aperture is situated in the zone which is not subjected to tension strain when working fluid is delivered under pressure into the chamber.

11 Claims, 5 Drawing Figures

HYDRAULIC PRESS ELASTIC STAMPING TOOL

The present invention relates to sheet-metal stamping by means of an elastic medium and has particular reference to a hydraulic press elastic stamping tool.

The invention may be used with advantage in making sheet-metal parts in aviation, automobile, instrument and domestic equipment industries.

Widely used at present for producing shaped sheet-metal parts are hydraulic presses wherein the tool acting on the blank is constituted by an elastic medium, for example, rubber or polyurethane. Commonly, such a press comprises a cylindrical bed whose upper carrier mounts a stamping tool. The body of the stamping tool has a recess which forms, in conjunction with an elastic diaphragm, a closed hydraulic chamber communicating with a source of working fluid under pressure. The press has several movably mounted tables each of which has a recess arranged to accommodate dies with blanks. When the working fluid is delivered into the hydraulic chamber, the hydraulic pressure causes the diaphragm to stamp parts according to the shape of the rigid dies.

The present art knows several types of elastic stamping tools which differ only in the construction of the elastic diaphragm.

Known in the art is an elastic stamping tool (Swedish Pat. No. 371,965) wherein the elastic diaphragm consists of two parts one of which is designed for sealing off the hydraulic chamber and the other for transmitting working fluid pressure to blanks. The first part is usually constructed as a thin-walled flat chamber flanged all the way along the perimeter. The end of the flange is vulcanized or glued to a flat plate rigidly secured to the bottom of the recess in the tool body. The sealing chamber is in contact with a thick-walled working diaphragm which is held in the tool body recess by two retaining plates secured to the end of the tool body.

When the working fluid is delivered under pressure into the tool body hydraulic chamber, the diaphragm flexes and stretches, filling the entire recess in the press table and shaping blanks in rigid dies. Thereafter the pressure is released from the hydraulic chamber, the working fluid is pumped out, a vacuum is built up in the hydraulic chamber, and the diaphragm returns into the initial position.

This elastic stamping tool suffers from the disadvantage that its thin-walled sealing chamber has poor durability and presents manufacturing difficulties inasmuch as, with the thinness of the chamber wall and substantially large chamber dimensions in plan, endeavor is called for in order to ensure that the chamber possesses a uniform strength and has no inclusions. The poor durability of the diaphragm is due to hard conditions of deformation of the thin-walled chamber at the flange where it is clamped between two rigid parts and is subjected to a pull into the working table recess. The durability of the diaphragm is also adversely affected by leaks developing where the chamber is vulcanized or glued to the metal plate, which is particularly so at pressures of the order of 700 to 1,000 bars.

Also known in the art is an elastic stamping tool (U.S.S.R. Inventor's Certificate No. 645,731) wherein the elastic diaphragm is constructed as one flat piece provided, all the way along the periphery, with a flange the end of which joins the flat part on a small radius. This flange end has an elastic narrowing edge which interacts with a special projection provided on the bottom of a recess in the stamping tool body, forming thereby a lip-type seal which makes tight the hydraulic chamber of the stamping tool body.

Fitted between the flat part of the diaphragm and the end of the flange is a frame closed in plan. It is rigidly secured to the tool body with fasteners installed through said flange end.

The frame is designed for attaching the diaphragm to the tool body and holding the diaphragm sealing edge against the tool body projection during creation of a vacuum in the hydraulic chamber of the tool body.

This tool also suffers from poor durability which, like above, is due to large deformations of the flat part where it joins the flange. Another disadvantage is poor tightness where the fasteners pass through the end of the flange.

Also known in the art is an elastic tool for sheet-metal stamping (U.S.S.R. Inventor's Certificate No. 437,628) wherein is installed an elastic diaphragm constructed as one self-sealing flat piece flanged all the way along the perimeter. The edges of the flange elastically interact with a projection, closed in plan, provided on the bottom of a recess in the tool body, whereby a lip-type seal is formed. The main part of the diaphragm joins the flange smoothly on a large radius. The pressure of the working fluid delivered into the hermetically sealed chamber of the tool body is transmitted by the diaphragm to blanks and also assists in holding the flange edge against the projection on the tool body.

This stamping tool suffers from the disadvantage that the strength and durability of the diaphragm are substantially affected by the great height of the flange necessitated by endeavor to obtain a smooth junction of the main part of the diaphragm with the end of the flange. Increase in the height of the diaphragm entails reduction of the strength of the tool body and increase in the amount of metal involved in the construction of the entire press, the latter disadvantage particularly manifesting itself with the use of a cylindrical press bed.

A further disadvantage of this stamping tool is poor tightness of the hydraulic chamber during creation of a vacuum therein for the purpose of returning the diaphragm into the initial position upon completion of the stamping operation.

It is the principal object of the present invention to decrease the height of a stamping tool whilst preserving high strength properties of the elastic diaphragm thereof.

It is another object of the present invention to provide for the hydraulic chamber formed by the diaphragm and the recess in the tool body to have a greater tightness throughout the press operating cycle.

It is still another object of the present invention to increase dependability and longevity of the stamping tool elastic diaphragm.

The invention resides in that in an elastic stamping tool comprising a body with a recess on the bottom of which a projection is provided some distance from the walls thereof and parallel therewith and further comprising a flat diaphragm situated in said recess and provided, all the way along the periphery, with a flange facing toward the bottom of said recess, the end portion of the flange being parallel to the plane of the diaphragm and having a sealing edge elastically interacting with said projection in the tool body recess and forming a hermetically sealed chamber communicating through ducts in the tool body with a source of working fluid under pressure, according to the invention said end portion of the flange forms, in conjunction with the main body of the diaphragm, a narrow aperture closed at one end and dimensioned several times smaller than the thickness of the diaphragm, the peripheral part of said aperture, in the cross section thereof, being smoothly curved with respect to the plane of the diaphragm toward the bottom of the recess and the closed end of the aperture being situated in the zone which is not subjected to tension strain when working fluid is delivered under pressure into said chamber.

This construction of the diaphragm enables minimizing the height thereof, which exceeds the sum of the thicknesses of the diaphragm main part and of the flange end only by the size of the narrow aperture. Also, this construction retains the large-radius smooth junction of the diaphragm main part with the flange end and thereby preserves the high strength and operation properties inherent in an elastic diaphragm with a sealing edge on the end of the flange.

It is desirable that the end portion of the flange should be rigidly secured to the tool body in order to enable the elastic edge of the flange to be held against the projection on the bottom of the tool body recess in all the stages of the stamping cycle, including creation of a vacuum in the hydraulic chamber, the working space of the tool being constantly kept tight.

It is further desirable that the end portion of the flange be attached to the tool body by means of a frame closed in plan and secured to the tool body with fasteners. This will ensure uniform and secure clamping of the flange end all the way along the perimeter.

It is still further desirable that said closed frame should be situated inside the end portion of the flange. In this case the fasteners extend from the diaphragm body beyond the sealing edge and therefore the presence of the fasteners and also of fastening holes in the tool body does not affect the high tightness of the hydraulic chamber. Furthermore, the rigid frame built into the diaphragm enhances the accuracy of the seatings in manufacturing the diaphragm. It will be noted that when making a diaphragm, for example, of polyurethane, the material shrinks by an amount changing from article to article, whereas the position of the flange end with respect to the projection in the tool body recess must be quite definite, otherwise the tightness of said lip-type seal may be impaired.

The provision of the rigid frame in the flange end prevents the diaphragm material from shrinking in plan and retains the specified dimensions of the diaphragm.

The invention will now be more particularly described by way of example with reference to the accompanying drawings, wherein.

Figure 1:
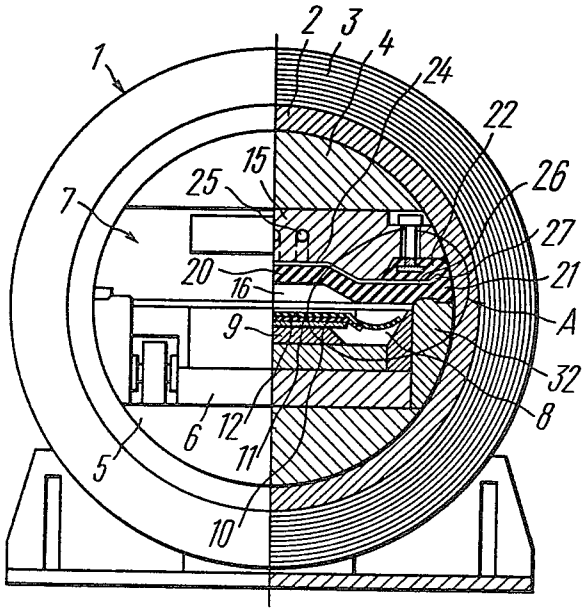
FIG. 1 is a cross sectional view of a hydraulic press with an elastic stamping tool according to the invention.

Referring to FIG. 1, the hydraulic press with an elastic stamping tool comprises a cylindrical bed 1 which, in this embodiment, incorporates a shell 2 reinforced with a winding 3 of high strength band, an upper carrier 4, a lower carrier 5, movable tables 6 (the drawings show only one table of two or four tables usually incorporated in the press), and a stamping tool 7. The use of materials with high mechanical properties in the bed 1, the cylindrical shape of the bed and the use of the shell 2 as a compression member ensure compact construction of the press and low metal consumption.

The movable table 6 has a recess 8 arranged to accommodate dies 9 with sheet-metal blanks 10 and elastic protection sheets 11. After loading, the whole recess is covered with an elastic protection blanket 12. The protection sheets 11 and the blanket 12 prevent the elastic stamping tool from direct contact with the rigid dies and blanks. The table 6 is mounted on wheels 13 (FIG. 2) which are situated in the working position over dampers 14.

Figure 2:
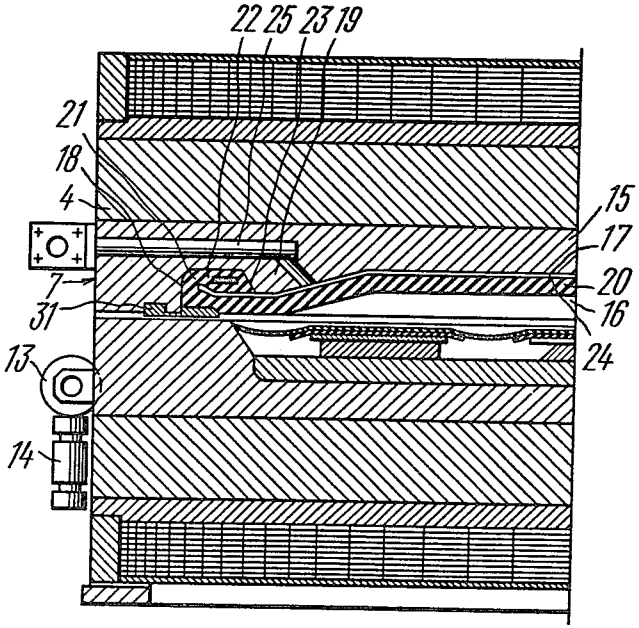
FIG. 2 is a longitudinal sectional view of a hydraulic press with an elastic stamping tool according to the invention.
Figure 3:
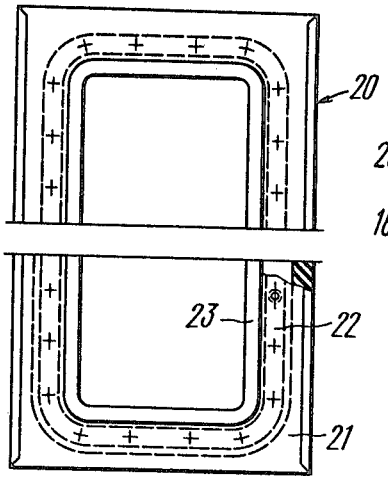
FIG. 3 shows an elastic diaphragm according to the invention (the stamping tool body is omitted for clarity)

The elastic stamping tool 7 is mounted on the upper carrier 4 and comprises a tool body 15 with a recess 16 on whose bottom 17 is provided a projection 19 located some distance from recess side walls 18 parallel therewith. The working element of the elastic stamping tool is constructed as a flat diaphragm 20 (FIGS. 2 and 3) which is situated in the recess 16 and has a flange 21 running all the way along the perimeter and facing toward the bottom 17 (FIG. 2). The end portion 22 (FIGS. 2 and 3) of the flange 21 is parallel to the plane of the diaphragm and has a sealing edge 23 elastically interacting with said projection 19 (FIGS. 2, 4 and 5) provided in the tool body 15. (The position of the sealing edge 23 in a free state is shown by the dot-and-dash lines in FIG. 4). The above elements form a lip-type seal between the tool body 15 and the diaphragm 20, which seal makes tight a closed chamber 24 (FIGS. 1, 4 and 5) communicating through a duct 25 (FIG. 2) in the tool body 15 with a source of working fluid under pressure (not shown). The end portion 22 (FIG. 1) of the flange 21 forms, in conjunction with the body of the diaphragm, an aperture 26 (FIGS. 4 and 1) with a closed end 27. The height of the aperture 26 is several times less than the thickness of the diaphragm 20.

The peripheral part of the aperture 26, in the cross section thereof, is smoothly curved with respect to the plane of the diaphragm toward the bottom 17 (FIG. 2) of the recess 16, and the closed end 27 (FIGS. 4 and 5) of the aperture 26 is situated in the zone which is not subjected to tension strain when working fluid is delivered under pressure into the chamber 24. This configuration of the flange 21 (FIG. 2) of the diaphragm 20 provides for secure tightness of the chamber 24 (FIG. 5), high durability of the diaphragm and low height threreof, which decreases the amount of metal involved in the press construction and increases the strength of the body 15 (FIG. 2) of the stamping tool 7. Increased strength of the tool body 15 is ensured by virtue of the low height of the walls 18 of the recess 16 of the tool body 15, which low height is directly proportional to stresses in the most loaded section of the tool body. Secure tightness of the chamber 24 (FIG. 5) is ensured by the lip-type seal formed by the interaction of the sealing edge 23 and the projection 19. Here the invention obviates the detrimental effect on the strength of the diaphragm which results in the prior art from clamping the elastic material between rigid parts and subjecting this material to a pull therefrom. The invention provides a hydraulic lock which ensures proper tightness irrespective of the pressure of working fluid and caters for favourable stress conditions of the diaphragm. Favorable strain conditions for the diaphragm 20 are also provided in the zone of diaphragm flexure caused by forcing the diaphragm into the recess 8 (FIGS. 1 and 5) in the press table 6. Here the diaphragm flexes on a relatively large radius and, consequently, the relative deformation of the fibers of the elastic material in this usually unsafe place is not great. The end 27 (FIG. 5) of the aperture 26 confined between the end portion 22 of the flange 21 and the main body of the diaphragm 20 is curved sharply, but being situated outside the zone of flexure and tension of the diaphragm 20, it lies where only all-directional compression exists, there being no tension strain. Therefore, the presence of sharply curved portions does not have an adverse effect on the strength of the diaphragm 20.

Figure 4:
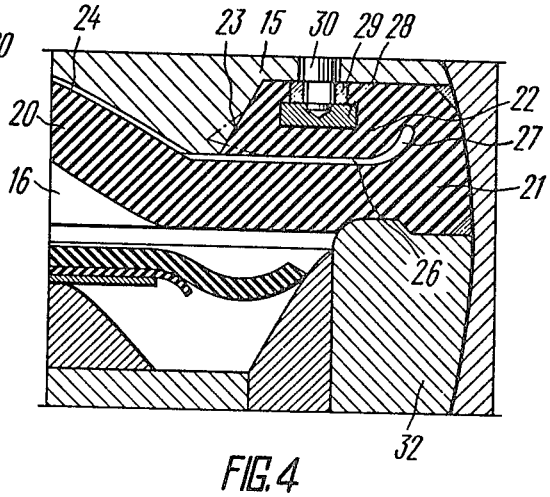
FIG. 4 is an enlarged view of the detail A in FIG. 1, with the stamping tool in the initial position.
Figure 5:
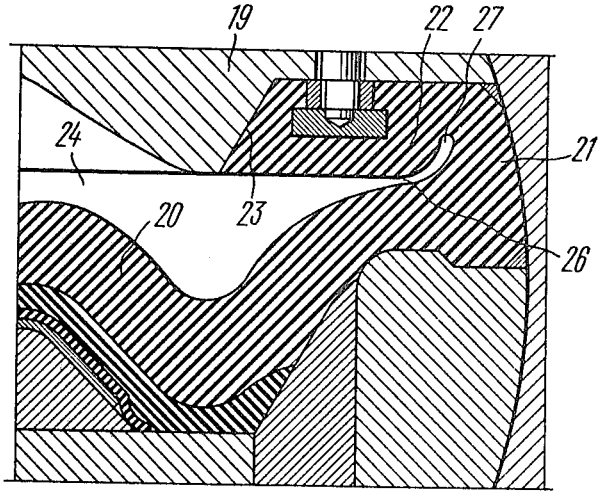
FIG. 5 is an enlarged view of the detail A in FIG. 1, with the stamping tool in the working position.

The diaphragm 20 may be secured in the tool body recess in various ways. In this embodiment of the elastic stamping tool 7 it is secured by means of a closed frame 28 (FIG. 4). This closed frame 28 has bosses 29 with threaded holes and is fitted inside the end portion 22 of the flange 21 of the diaphragm 20. Fasteners (studs) 30 are screwed in those threaded holes whereby the end portion 22 and, consequently, the diaphragm 20 is rigidly secured to the tool body 15, due to which the diaphragm tightly seals the chamber 24 in all the stages of the press operating cycle, including creation of a vacuum in the chamber 24. The fitting of the frame 28 inside the end portion 22 of the flange 21 absolutely does not interfere with the tightness of the chamber 24, inasmuch as the fastening parts and holes are situated beyond the sealing edge 23.

When manufacturing the diaphragm 20, the frame 28 with the bosses 29 is rigidly fixed to a press mold for rubber or a casting mold for polyurethane and is left embedded in the flange end portion 22 after mold removal.

After installing the diaphragm 20 (FIG. 4) into the recess 16 in the tool body 15 and securing it with studs 30, plates 31 are mounted on the two short opposite sides of the tool body 15. The plates 31 are attached so as to have a limited movement and are designed to close the gap between the tool body 15 and the surface of the press table (6) (FIG. 1).

The whole assembly of the elastic stamping tool 7 is mounted in the press on the upper carrier and secured in place by means of side spacers 32.

The elastic stamping tool operates as follows.

With the table 6 (FIG. 1) moved out of the press, the table recess 8 is loaded with dies 9 and blanks 10 which are then covered with the protection sheets 11. As the table 6 is moved into the press, the whole recess 8 is automatically covered by the protection blanket 12. The table is placed in the working position under the stamping tool 7 so that the wheels 13 (FIG. 2) rest on the dampers 14. Thereafter working fluid is delivered under pressure through the duct 25 into the chamber 24. The diaphragm 20 (FIG. 5) flexes, filling all the spaces between the dies in the table recess, and stamps the blanks on the dies with a pressure equal to that of the working fluid. When the pressure in the chamber 24 (FIG. 1) rises, the table 6 lowers onto the lower carrier 5, compressing the dampers 14 (FIG. 2), and the plates 31 (FIG. 4) fit against the surface of the table 6 (FIG. 1) and close the gap between the tool body 15 (FIG. 2) and the table 6 (FIG. 1). As the pressure rises further, the gap increases because the bed 1 stretches, but the plates 31 constantly keep the gap closed.

The commencement of the pressure rise in the chamber 24 is made possible by the fact that the sealing edge 23, which is held against the projection 19 by the forces of elasticity, forms a lip-type seal to make the chamber tight. As the pressure of the working fluid rises further, it adds to the elastic force holding the sealing edge, which provides secure tightness of the chamber irrespective of the fluid pressure level. The forces exerted by the working fluid are taken radially by the cylindrical bed 1 and longitudinally by the walls 18 (FIG. 2) of the tool body 15 and by the table 6. Since the construction of the diaphragm 20 according to the invention provides for small height of the walls 18, the problem of ensuring safe stress in the tool body 15 presents no difficulty even at pressures of the order of 1,000 to 1,500 $kgf/cm^2$.

Upon completion of the stamping process the pressure in the chamber 24 is released, the working fluid is pumped out, and a vacuum is built up in the chamber 24 for the diaphragm 20 to surely return into the initial position without sagging of the diaphragm center part, which sagging, if allowed, will interfere with moving out the table 6 (FIG. 1). In building up a vacuum in the chamber 24, the end portion 22 (FIG. 4) of the flange 21 is constantly held by the frame 28 to the tool body 15, whereby tightness of the chamber 24 is also ensured during this stage of the press operating cycle. After the diaphragm returns into the initial position, the table 6 (FIG. 1) is moved out of the press, the blanket 12 is automatically taken off the recess 8 in the table 6 and the operators unload the table, which ends the operating cycle. The next cycle is carried out by the use of a second table (not shown) which is loaded during the stamping operation on the first table.

What is claimed is:

1. A hydraulic press elastic stamping tool comprising a tool body; a recess provided in said tool body; a projection provided on the bottom of said recess some distance from the walls thereof; a flat elastic diaphragm situated in said recess and provided around its perimeter with a flange facing toward the bottom of said recess, the end portion of the flange being parallel to the plane of the diaphragm and having a sealing edge which makes contact with said projection in the tool body recess, forming a hermetically sealed chamber;

ducts provided in said tool body for communicating said chamber with a source of working fluid under pressure; said flat elastic diaphragm end portions forming in conjunction with the main body of the diaphragm an aperture closed at one end and dimensioned at least four times smaller than the thickness of the diaphragm, the peripheral part of said aperture, in cross section thereof, being smoothly curved with respect to the plane of the diaphragm toward the bottom of the recess, and the closed end of the aperture being situated in a zone which is not subjected to tension strain when working fluid is delivered under pressure into said chamber.

2. A stamping tool as in claim 1, wherein said end portion of the flange is rigidly secured to said tool body.

3. A stamping tool as in claim 2, wherein said end portion of the flange is secured to said tool body by means of a closed frame attached to said tool body with fastening elements.

4. A stamping tool as in claim 3, wherein said frame is fitted inside said end portion of the flange.

5. A hydraulic press elastic stamping tool comprising a tool body; a recess provided in said tool body; a projection provided on the bottom of said recess spaced from side walls thereof; an elastic diaphragm situated in said recess and having a main body provided, all the way along its perimeter, with a flange facing toward the bottom of said recess, the end portion of the flange having a sealing edge which contacts and elastically interacts with said projection in the tool body recess to form a hermetic seal therebetween thereby forming a hermetically sealed chamber between the main body of said diaphragm and said tool body;

a duct provided in said tool body for communicating said chamber with a source of working fluid under pressure; said elastic diaphragm end portions being turned over and forming in conjunction with the main body of the diaphragm an aperture closed at one end and dimensioned smaller than the thickness of the diaphragm, the peripheral part of said aperture, in cross section thereof, being curved toward the bottom of the recess and the closed end of the aperture being situated in a zone not subjected to tension strain when working fluid is delivered under pressure into said chamber.

6. A stamping tool as in claim 5, wherein said end portion of the flange is rigidly secured to said tool body.

7. A stamping tool as in claim 6, wherein said end portion of the flange is secured to said tool body by means of a closed frame attached to said tool body with fastening elements.

8. A stamping tool as in claim 7, wherein said frame is fitted inside said end portion of the flange.

9. A stamping tool as in claim 5, wherein said main body of said elastic diaphragm when not subjected to the fluid under pressure has a substantially flat central portion, said curve of said aperture being smoothly curved with respect to the plane of the flat portion.

10. A stamping tool as in claim 9, wherein a surface of said flange end portion is parallel with the plane of the flat portion.

11. A stamping tool as in claim 1 or 5, wherein said aperture is positioned in a region located between side walls of the recess and said projection.

* * * * *